US005495081A

United States Patent [19]

Ipcinski

[11] Patent Number: 5,495,081

[45] Date of Patent: Feb. 27, 1996

[54] ACTUATOR FOR A PUSH BUTTON SWITCH

[75] Inventor: Ralph G. Ipcinski, Hollis, N.H.

[73] Assignee: C&K Components, Inc., Newton, Mass.

[21] Appl. No.: 185,527

[22] Filed: Jan. 24, 1994

[51] Int. Cl.[6] ..... H01H 3/12

[52] U.S. Cl. ..... 200/341; 200/276.1; 200/305

[58] Field of Search ..... 200/344, 276.1, 200/305

[56] References Cited

U.S. PATENT DOCUMENTS

| | | | |
|---|---|---|---|
| 4,126,774 | 11/1978 | Gossling | 200/314 |
| 4,313,685 | 2/1982 | Stahl, et al. | 200/276.1 |
| 4,350,857 | 9/1982 | Fillus, et al. | 200/314 |
| 4,434,338 | 2/1984 | Rood | 200/276.1 |
| 4,496,813 | 1/1985 | Fukushima | 200/314 |

*Primary Examiner*—Henry J. Recla
*Attorney, Agent, or Firm*—Pearson & Pearson

[57] ABSTRACT

This is an actuator for a push-button switch. The actuator has a cover with a top having an underside and a through opening, a housing, a plunger, a spring and a lamp. The push-button switch includes a button subassembly attached to the underside and engaging the spring. The cover also has tabs extending from each side which has a locking element extending from the inner surface of each tab which engages a slot formed on each side of the base of the push-button switch to hold the cover and the base together.

4 Claims, 6 Drawing Sheets

ACTUATOR FOR A PUSH BUTTON SWITCH

BACKGROUND OF THE INVENTION

This invention relates generally to a push-button switch, and more specifically to a push-button switch having a cover with a top having an underside and a through opening.

SUMMARY OF THE INVENTION

This is a push-button switch having a cover with a top having an underside and a through opening. The push-button switch includes a button subassembly attached to the underside and engaging the through opening. The cover also has tabs extending from each side which has a locking element extending from the inner surface of each tab which engages a slot formed on each side of the base of the push-button switch to hold the cover and the base together.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
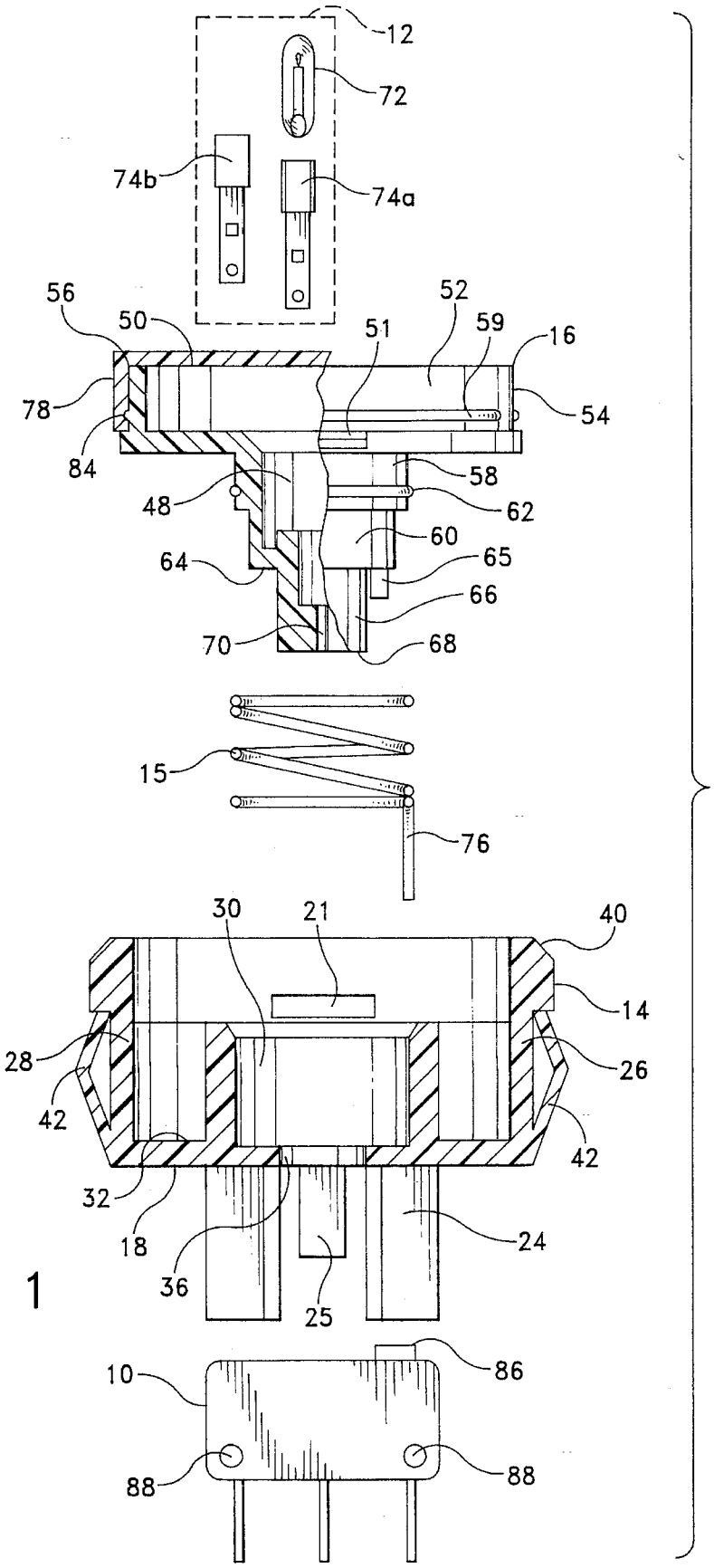
FIG. 1 is an exploded front elevational view of the push-button switch according to the present invention.

There is shown in FIG. 1 a push-button switch 10, a lamp 12, a housing 14, a compression spring 15 and a plunger 16.

Figure 2:
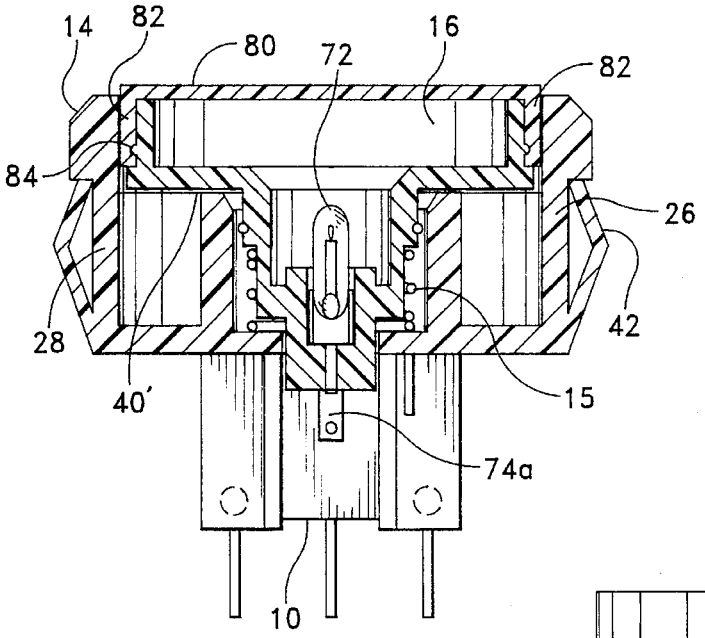
FIG. 2 is a sectional view of the push-button switch shown in FIG. 1 assembled.
Figure 3:
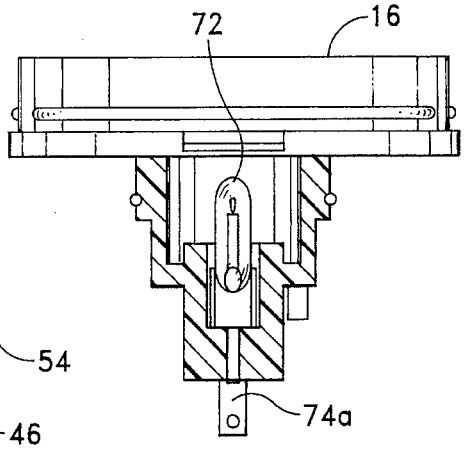
FIG. 3 is a sectional view partly in elevation of the plunger and lamp of the push-button switch shown in FIG. 1.
Figure 7:
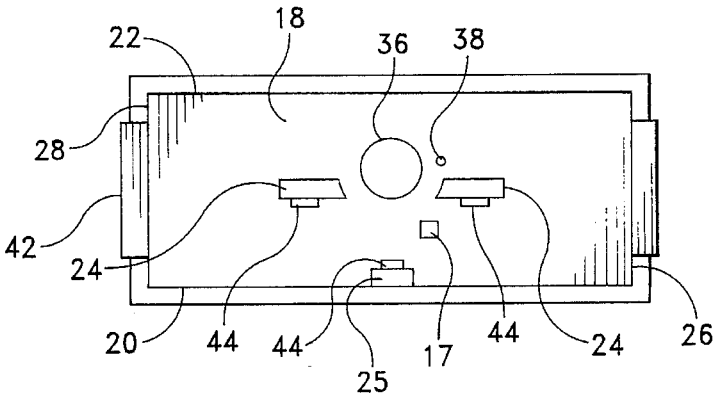
FIG. 7 is a bottom plan view of the housing according to the present invention.
Figure 8:
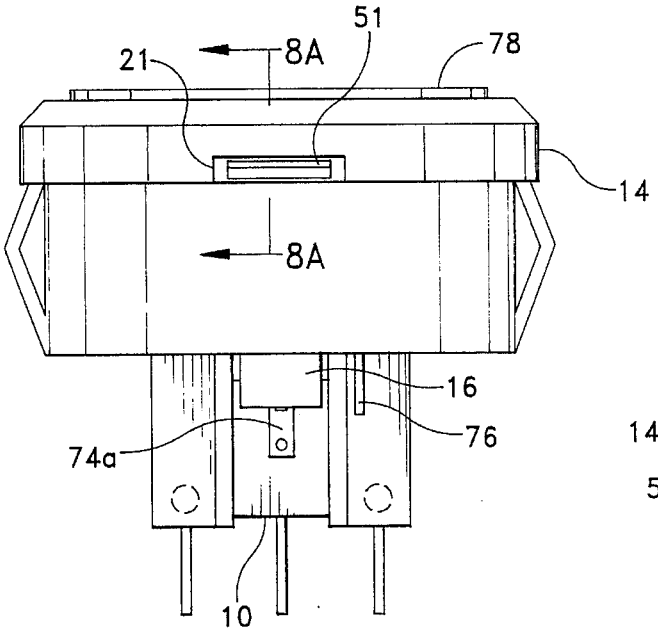
FIG. 8 is a front elevational view of the housing according to the present invention.
Figure 8A:
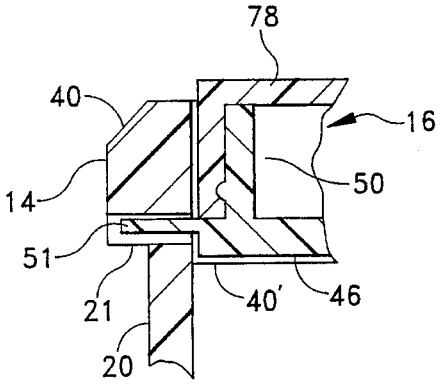
FIG. 8A is a sectional view of a portion of the housing of FIG. 8 taken along section line 8A.

The housing 14 has a base 18 which has a first long edge, a second long edge, a first short edge and a second short edge. A first long side 20 extends integrally from the first long edge and a second long side 22 extends integrally from the second long edge in spaced parallel relation to the first long side 20 as shown in FIG. 7. A pair of spaced integral tabs 24 extends from the rear center of the base 18 and are spaced from each other. First and second short sides 26, 28 connect the first and second long sides 20, 22 to complete the box-like configuration of the housing 14. A centrally positioned slot 21 is formed on each of the exterior surfaces of the first and second long sides 20, 22. A first long, circular interior wall 30 extends integrally from upper surface 32 of the base 18 positioned within the box-like configuration of the housing 14. The exterior surface of each of the first and second short sides 26, 28 comprise an enlarged top portion 40 which narrows to form the remaining part of the short side. As shown in FIG. 7, a first opening 36 is formed through the base 18. A second opening 38 of smaller diameter than the first opening 36 is formed through the base 18 adjacent the first opening 36. An integral triangular arm 42 extends from the juncture of the base 18 and the exterior of each of the short walls 26, 28 terminating under the shoulder formed by the top portion 40 and the remaining part of the short sides 26, 28. Each of the tabs 24 includes a positioned extension 44, as shown in FIG. 7. A second tab 25 which is adjacent a free terminal end also has a positioned extension 44. The top of the interior wall 30, is positioned on a plane 40' defined at or near the juncture of the top portion 40 and the remaining part of the short sides 26, 28 as shown in FIG. 2.

Figure 4:
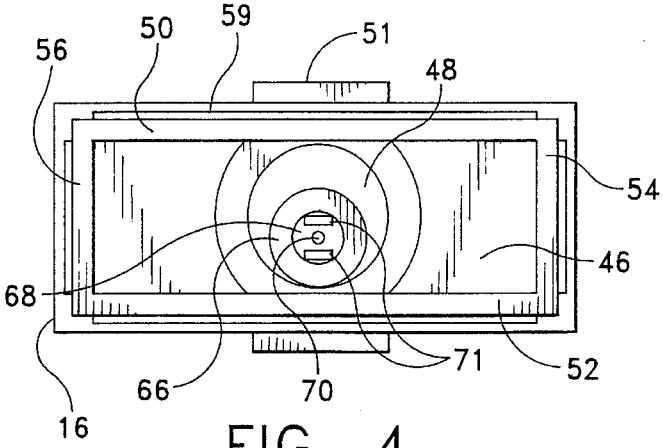
FIG. 4 is a top plan view of the plunger and lamp shown in FIG. 3.
Figure 5:
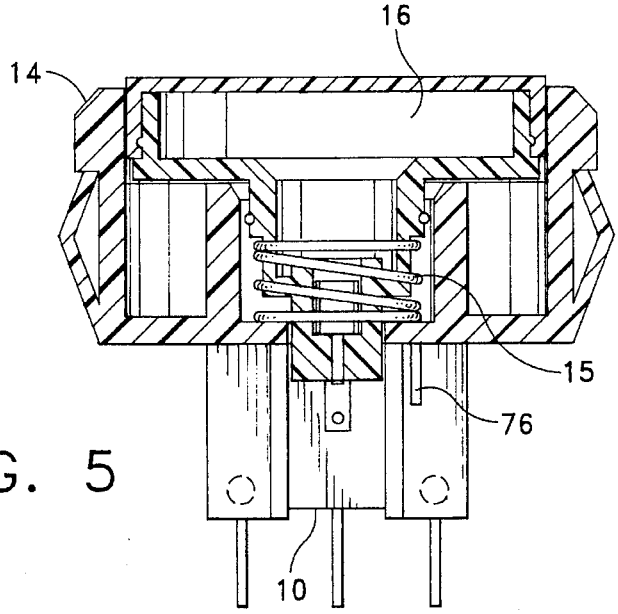
FIG. 5 is a sectional view of the plunger and housing and the spring in elevation of the push-button switch shown in FIG. 1.
Figure 6:
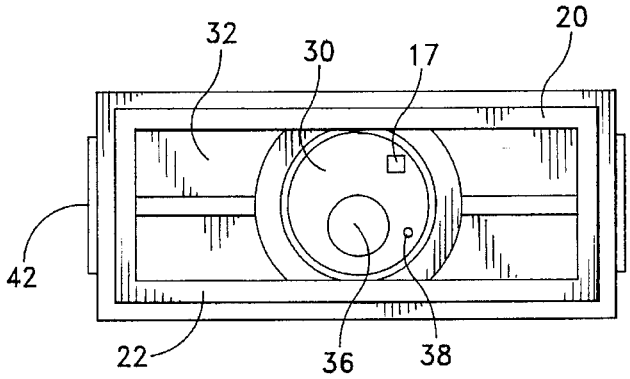
FIG. 6 is a top plan view of the plunger and housing of the push-button switch shown in FIG. 1.

Referring to FIG. 1 and FIG. 4 plunger 16 comprises a base portion 46 generally rectangular in configuration having a centrally positioned tubular interior portion 48 formed therein. A first long secondary wall 50 extends integrally from the base portion 46 and a second long secondary wall 52 extends integrally from the base portion 46 in spaced parallel relation to the first long secondary wall 50. A rectangular member 51 extends centrally from the exterior of plunger 16 adjacent the long walls 50, 52. The walls 50, 52 are spaced inward from the periphery of the base portion 46. First and second short secondary walls 54, 56 connect the first and second long secondary walls 50, 52 to complete the box like configuration. The first long secondary wall 50, the second long secondary wall 52, the first short secondary wall 54 and second short secondary walls 56 each have an exterior surface from which a centrally positioned rib 59 extends. A first tubular prolongation 58 extends coaxially with the interior portion 48 from the lower surface of the base portion 46. A second prolongation 60 extends coaxially from the first tubular prolongation 58. The first tubular prolongation 58 has a thicker wall than the second prolongation 60. The inner surface of the wall of the second prolongation 60 forms a continuation of the inner wall of the first tubular prolongation 58 and defines the outer walls of the inner portion 48. The outer surface of the first tubular prolongation 58 proximate its juncture with the second prolongation 60 includes a circumferential groove having an O-ring 62 mounted therein. The second prolongation 60 terminates at a circumferential inner flange 64. A square actuator rod 65 extends from the external surface of the inner flange 64 as shown in FIG. 1. A tubular, terminal housing 66 is integrally formed in the through aperture defined by the inner flange 64 as shown in FIG. 1. The terminal housing 66 includes a foundation portion 68 which includes a centrally positioned, through hole 70 between two slots 71. The compression spring 15 includes a lead or tail 76. The lamp 12 includes an indicator light 72 mounted between first and second terminal elements 74*a*, 74*b*. The first terminal element 74*a* includes a holding portion which has a rectangular base and which has a pair of spaced side walls upwardly therefrom to provide a trough like configuration. A planar, rectangular termination extends integrally from one end to complete the first terminal 74*a*. The second terminal 74*b* includes a holding portion which has a rectangular base and has a planar, rectangular termination extending integrally from one end to complete the second terminal 74*b*.

A rectangular cap portion 78 includes a cap 80. A series of walls 82 extends integrally and perpendicular from the edges of the cap 80 to provide a box like configuration. A channel 84 is formed on the interior surface of each of the walls 82 and positioned to be engaged by the ribs 59 of the plunger 16.

Referring to FIG. 1 and FIG. 4, the first terminal element 74*a* and the second terminal element 74*b* of the push button switch 10 are assembled by inserting the planar, rectangular termination of the first terminal element 74*a* into and through one of the slots 71 thus positioning the holding portion within the terminal housing 66 and the planar, rectangular termination of the first terminal element 74*a* outside the exterior of the terminal housing 66. The planar, rectangular termination of the second terminal element 74*b* is passed into and through the other slot 71 positioning the holding portion within the terminal housing 66 and the planar, rectangular termination of the first terminal element 74*a* outside the exterior of the terminal housing 66. The first and second terminal elements 74*a*, 74*b* are in spaced, parallel relation with each other. The indicator light 72 is pushed between the holding portions of the first and second terminal elements 74*a*, 74*b* making a physical and electrical connection between the first and second terminal elements 74*a*, 74*b* and the indicator light 72. The body of the spring 15 circumscribes the external surface of the second prolongation 60.

The sub assembly of the plunger 16, the lamp 12, the first and second terminals 7A and 7B 74*a* and 74*b* and the compression spring 15 can now be assembled with the housing 14. The terminal housing 66 with its first and second terminal elements 74*a*, 74*b* and the spring 15 is passed into the housing 14. The spring lead 76 is inserted into the second opening 38 of the base 18 to secure the spring in the housing 14 and to prevent it from turning. The lead 76 provides for connection to an external ground wire. In this position the planar, rectangular termination of the first and second terminal elements 74*a*, 74*b* are passed through the first aperture 36 to lie between the tabs 24 and the lead 76 of the compression spring 15 is passed through the second aperture 38 to extend in front of one of the tabs 24. The rectangular members 51 of the plunger 16 are passed through the slots 21 of the housing 14 to hold the plunger 16 and the housing 14 together. The square actuator rod 65 is passed through a square opening 17 formed through the base 18 of the housing 14 as shown in FIG. 7.

The cap portion 78 is engaged to the plunger 16 by engaging the ribs 59 with the channels 84.

The push button switch 10 as shown in FIG. 1 includes a button or actuator 86, a pair of spaced, blind holes 88 on one side and a single centered hole 88 on the other parallel side (not shown) of switch 10. Switch 10 is pushed in-between the tabs 24 and the second tab 25 until the positioned extensions 44 engage in the holes 88. In this position, the button 86 is directly beneath the terminal end of the actuator rod 65. If pressure is applied to the cap portion 78 the compression spring 15 will compress moving the terminal end of the actuator rod 65 against the button 86 actuating the switch 10. The lead 76 has a ground wire attached to it.

A variation of the push-button switch 10, the lamp 12, the housing 14, the compression spring 15 and the plunger 16 is shown in FIGS. 9–15. The variation includes a push-button switch 10*a*, a lamp 12*a*, a housing 14*a*, a compression spring 15*a* and a plunger 16*a*.

Figure 12:
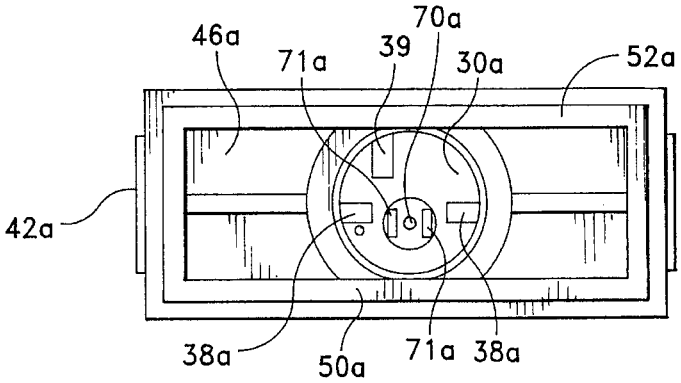
FIG. 12 is a top plan view of the housing shown in FIG. 9.
Figure 13:
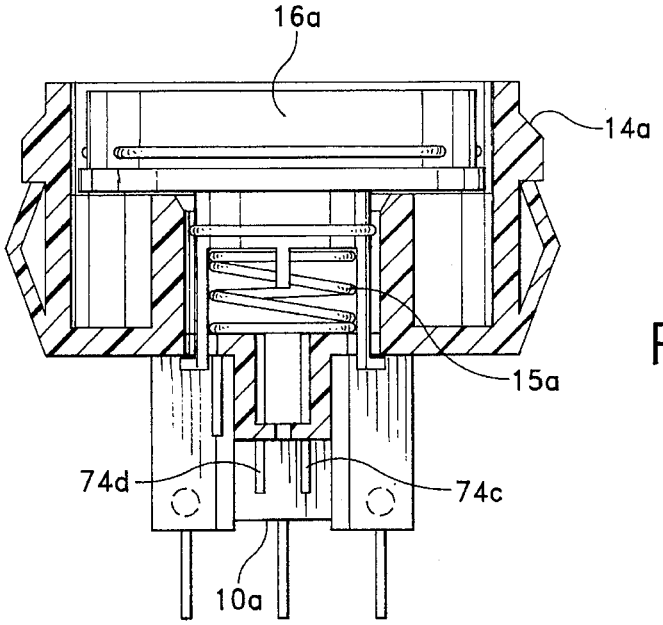
FIG. 13 is a sectional view partly in elevation of the plunger and spring of the push-button switch shown in FIG. 9.
Figure 14:
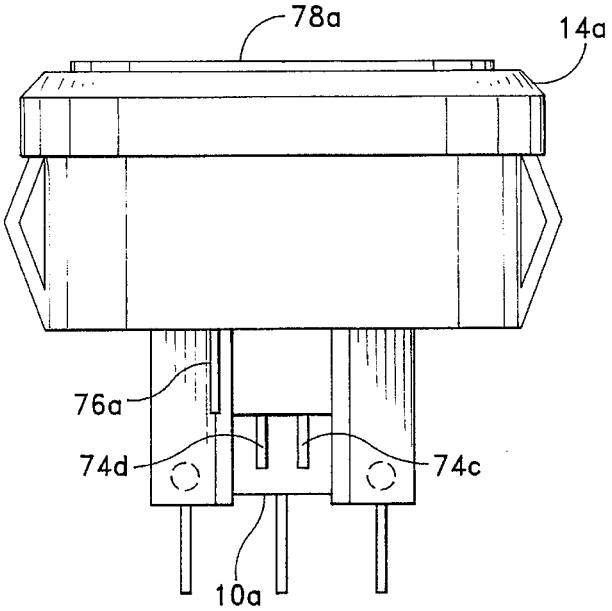
FIG. 14 is a front elevational view of the push-button switch shown in FIG. 9.
Figure 15:
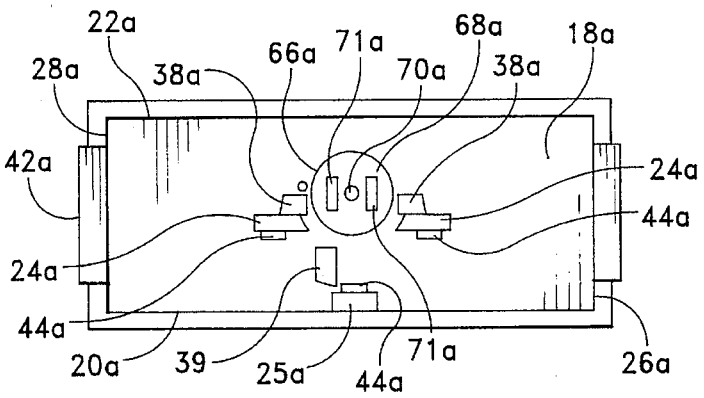
FIG. 15 is a bottom plan view of the housing according to the present invention.

The housing 14*a* has a base 18*a* which has a first long edge, a second long edge, a first short edge and a second short edge. A first long side 20*a* extends integrally from the first long edge and a second long side 22*a* extends integrally from the second long edge in spaced parallel relation to the first long side 20*a*. A pair of spaced integral tabs 24*a* extend from the rear center of the base 18*a* and are spaced from each other. First and second short sides 26*a*, 28*a* connect the first and second long sides 20*a*, 22*a* to complete the box-like configuration of the housing 14*a*. A first long, circular interior wall 30*a* extends integrally from upper surface 32*a* of the base 18*a* positioned within the box-like configuration of the housing 14*a*. An integral, tubular terminal housing 66*a* extends from the base 18*a* in coaxially relation with the tube-like configuration defined by the first long, circular interior wall 30*a*. The terminal housing 66*a* includes a foundation portion 68*a* which in turn includes a centrally positioned, through hole 70*a* positioned between two slots 71*a*. The lamp 12 includes an indicator light 72*a* mounted between third and fourth terminal elements 74*c*, 74*d*. The third terminal element 74*c* includes a holding portion which has a rectangular base and which has a pair of spaced side walls upwardly therefrom to provide a trough-like configuration. A planar, rectangular termination extends integrally from one end to complete the third terminal element 74*c*, as seen in FIGS. 9A and 9B. Likewise, the fourth terminal 74*d* includes a holding portion which has a rectangular base and has a planar, rectangular termination extends integrally from one end to complete the fourth terminal 74*d*. The exterior surface of each of the first and second short sides 26*a*, 28*a* comprise; an enlarged top portion 40*a* which narrows to form the remaining part of the short side. As shown in FIG. 15, a first opening 70*a* is formed through the base 18*a*. A pair of second openings 38*a* which are rectangular in configuration, are positioned on each side of the first opening 70*a* in close proximity to the first long circular interior wall 30*a*. A spring hole 39 is formed through the base 18*a* as shown in FIG. 12. An integral triangular arm 42*a* extends from the juncture of the base 18*a* and the exterior of each of the short walls 26*a*, 28*a* terminating under the shoulder formed by the top portion 40*a* and the remaining part of the short side. A second tab 25*a* extends from the first long side 20*a*.

Figure 9:
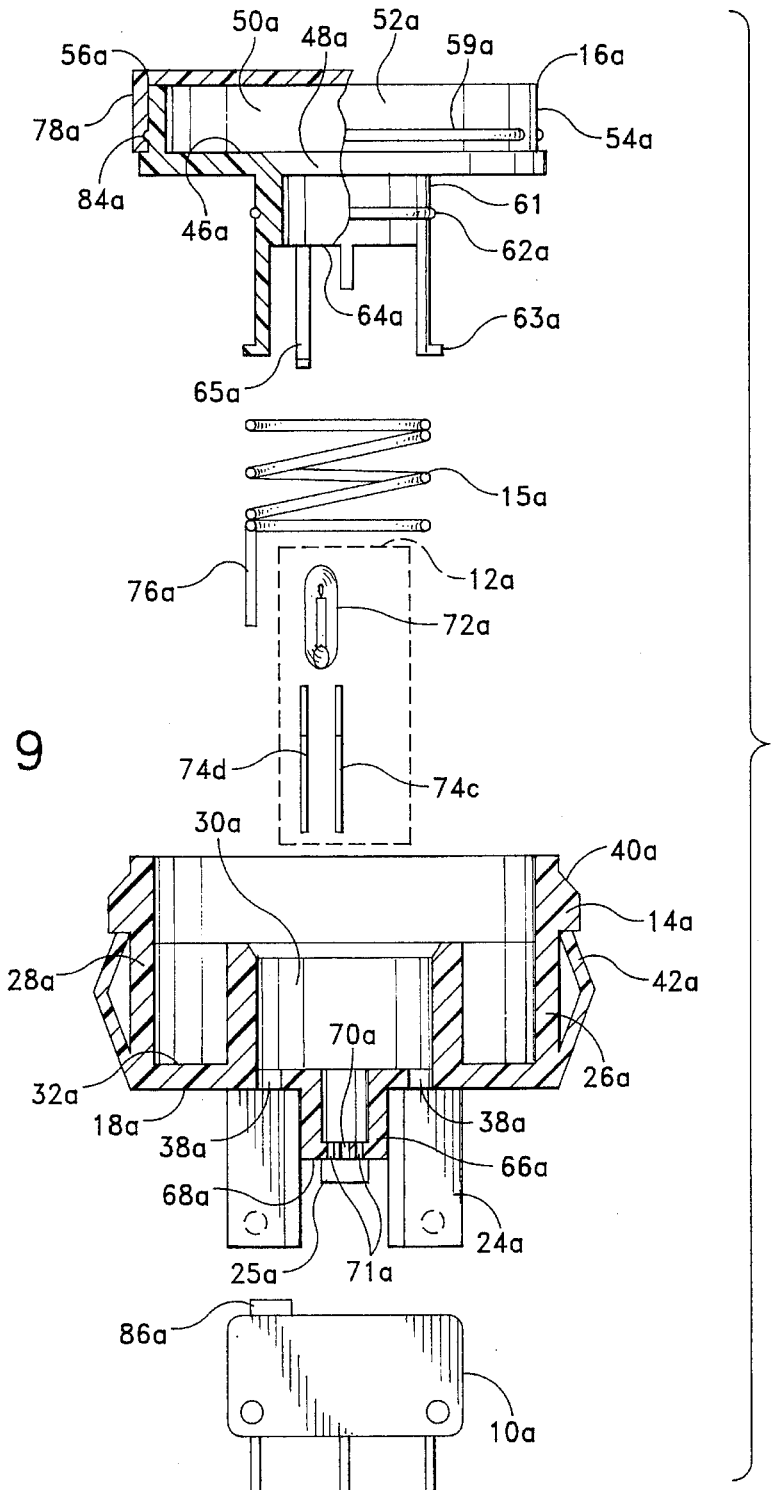
FIG. 9 is an exploded front elevational view of the push-button switch according to a variation of the present invention.
Figure 9A:
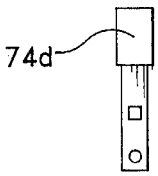
FIG. 9A is a side elevational view of one of the terminals of the push-button switch shown in FIG. 9.
Figure 9B:
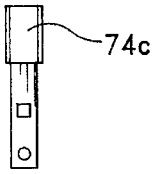
FIG. 9B is an opposite side elevational view of the other of the terminals of the push button switch shown in FIG. 9.

Referring now to FIG. 9 and FIG. 12, the plunger 16*a* comprises a base portion 46*a* generally rectangular in configuration having a centrally positioned tubular interior portion 48*a* formed therein. A first long secondary wall 50*a* extends integrally from the base portion 46*a* and a second long secondary wall 52*a* extends integrally from the base portion 46*a* in spaced parallel relation to the first long secondary wall 50*a*. The walls 50*a*, 52*a* are spaced inward from the periphery of the base portion 46*a*. First and second short secondary walls 54*a*, 56*a* connect the first and second long secondary walls 50*a*, 52*a* to complete the box-like configuration. The first long secondary wall 50*a*, the second long secondary wall 52*a*, the first short secondary wall 54*a* and second short secondary wall 56*a* each have an exterior surface from which a centrally positioned rib 59*a* extends. A tubular wall 61 extends coaxially from the interior portion 48*a* at the lower surface of the base portion 46*a*. The tubular wall 61 has an upper thicker portion which is of less width than the lower portion as shown in FIG. 9. The outer surface of the lower thinner portion of the tubular wall 61 forms a continuation of the upper thicker portion of the tubular wall 61. The upper thicker portion of the tubular wall 61 proximate its juncture with the lower thinner portion of the tubular wall 61 includes a circumferential groove having an O-ring 62*a* mounted therein. A square actuator rod 65*a* extends from the external surface of the inner flange 64*a* as shown in FIG. 9. The free terminal end of the tubular wall 61 is bent outwardly 90 degrees to form a flange 63*a*. The compression spring 15*a* includes a lead or tail 76*a*.

Figure 10:
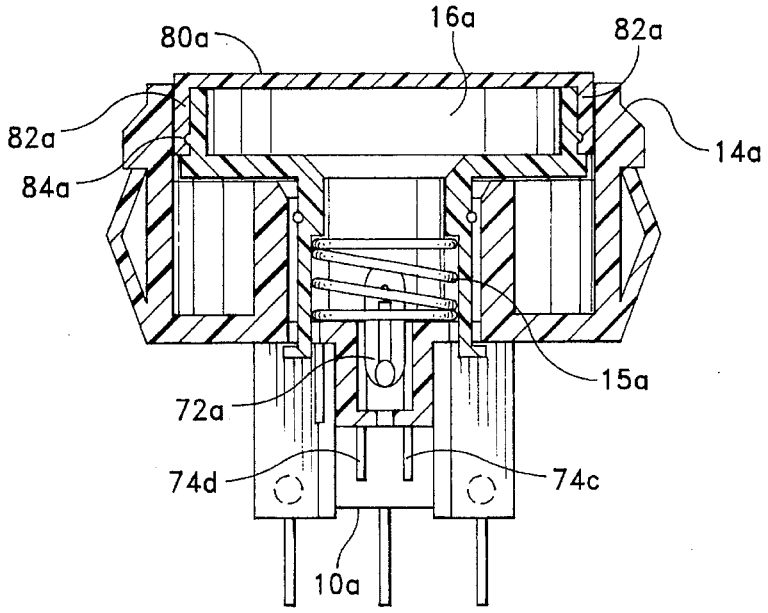
FIG. 10. is a sectional view of the push-button switch shown in FIG. 9 assembled.
Figure 11:
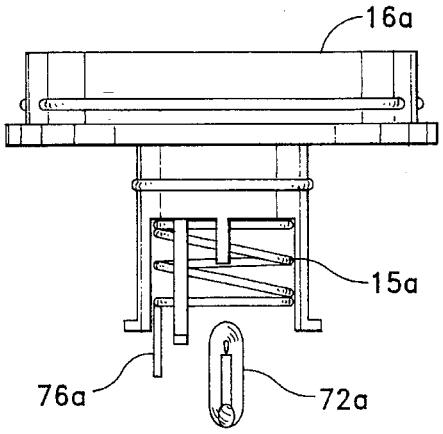
FIG. 11 is a front elevational view of the plunger, spring and lamp of the push-button switch shown in FIG. 9.

Referring to FIG. 9 and FIG. 10, a rectangular cap portion 78*a* include a cap 80*a*. A series of walls 82*a* extends integrally from the edges of the cap 80*a* to provide a box-like configuration. A channel 84*a* is formed centrally on the interior surface of each of the walls 82*a*.

Referring to FIG. 9 and FIG. 12 the third terminal element 74*c* and the fourth terminal element 74*d* of the push button switch 10*a* are assembled by inserting the planar, rectangular termination of the third terminal element 74*c* into and through one of the slots 71*a* thus positioning the holding portion within the terminal housing 66*a* and the planar, rectangular termination of the third terminal element 74*c* outside the exterior of the terminal housing 66*a*. The planar, rectangular termination of the fourth terminal element 74*d* is passed into and through the other slot 71*a* positioning the holding portion within the terminal housing 66*a* and this planar, rectangular termination of the fourth terminal element 74*d* outside the exterior of the terminal housing 66*a*. The third and fourth terminal elements 74*c*, 74*d* are in L spaced, parallel relation with each other. The indicator light 72*a* is pushed between the holding portions of the third and fourth terminal elements 74*c*, 74*d* making a physical and electrical connection between the third and fourth terminal elements 74*c*, 74*d* and the indicator light 72*a*. The lead or tail 76*a* of spring 15*c* is inserted through the spring aperture 39.

The plunger 16*a* is assembled with the sub assembly of the housing 14*a*, the third and fourth terminal elements 74*c*, 74*d*, the spring 15, and the indicator light 72*a* by inserting the flanges 63*a*, after compressing them toward each other, through the second openings: 38*a*. The body of the spring 15 will therefore be inserted within the cavity defined by the lower thinner portion of the tubular wall 61. The cap portion 78*a* is engaged to the plunger 16*a* by engaging the ribs 59*a* with the channels 84*a*.

What I claim is:

1. An actuator for a push button switch comprising a housing, a plunger means, and a spring, the housing comprises a base, the base having an upper surface from which outer walls extend defining a first cavity, inner walls extend from said upper surface defining a second cavity, and an aperture provided therethrough within said second cavity, the outer walls surrounding the inner walls in varying spaced relation, the base having means for engaging a push button switch, the plunger means comprises a base portion, the base portion including an upper surface, a cap engaging portion extending from the upper surface, and an edge defining a central, through aperture, and a tubular prolongation extending away from the base portion, the tubular prolongation including an outer surface and a terminal end with a through hole formed therein, and the spring comprises a spring body and a lead extending therefrom such that the spring and the plunger means define a sub assembly with the spring body circumscribing and abutting the outer surface of the prolongation and the lead extending beyond the prolongation, the sub assembly positioned within the second cavity of the housing with the lead of the spring extending through the aperture within said second cavity of the base of the housing.

2. The actuator for a push button switch set forth in claim 1 further comprises a lamp, the lamp includes an indicator light mounted between first and second terminal elements, a portion of the first and second terminal elements positioned in the through hole of the terminal end of the prolongation.

3. The actuator for a push button switch set forth in claim 1 further comprises a cap portion which includes a cap having edges, a series of cap walls extend integrally from the edges of the cap and perpendicular thereto, each of the cap walls has an interior surface, a channel is formed on the interior surface of each of the cap walls, walls extend from the upper surface of the base; portion, each wall has an exterior surface from which a centrally positioned rib extends, the cap portion being engaged to the plunger by engaging the ribs within the channels.

4. The actuator for a push button switch set forth in claim 1 wherein the means of engaging the push button switch comprises a pair of spaced integral tabs extending from the base and are aligned and spaced from each other and a second tab extending from the base and spaced from the integral tabs whereby the push button switch is held between the pair of spaced integral tabs and the second tab.

* * * * *